US007343835B2

(12) United States Patent
Jensen

(10) Patent No.: US 7,343,835 B2
(45) Date of Patent: Mar. 18, 2008

(54) SAFETY OPENER

(76) Inventor: Christopher G. Jensen, 1735 W. Ellen St., Chicago, IL (US) 60622

( * ) Notice: Subject to any disclaimer, the term of this patent is extended or adjusted under 35 U.S.C. 154(b) by 0 days.

(21) Appl. No.: 11/524,594

(22) Filed: Sep. 20, 2006

(65) Prior Publication Data

US 2007/0079668 A1 Apr. 12, 2007

Related U.S. Application Data

(60) Provisional application No. 60/725,102, filed on Oct. 7, 2005.

(51) Int. Cl.
*B67B 7/44* (2006.01)

(52) U.S. Cl. ..... 81/3.27; 81/3.09

(58) Field of Classification Search ..... 81/3.27, 81/3.55

See application file for complete search history.

(56) References Cited

U.S. PATENT DOCUMENTS 795,330 A * 7/1905 Brewington et al. ..... 81/3.55
1,610,437 A * 12/1926 Frick ..... 81/3.08
D158,957 S * 6/1950 Haberkorn et al. ..... D8/18
2,568,612 A * 9/1951 Cullen ..... 30/450
2,611,286 A * 9/1952 Baker ..... 81/3.55
2,853,906 A * 9/1958 Pesta ..... 81/3.27
D278,024 S * 3/1985 Hoffman et al. ..... D8/40
D278,203 S * 4/1985 Braukmann ..... D8/40
4,633,740 A * 1/1987 Jacobs ..... 81/3.09
4,681,358 A * 7/1987 Smith ..... 294/15
4,967,622 A * 11/1990 Phillips ..... 81/3.09
5,082,145 A * 1/1992 McDonald ..... 222/105
5,313,858 A * 5/1994 Stitt ..... 81/3.55
D382,784 S * 8/1997 Kagiyama et al. ..... D8/40
6,070,497 A * 6/2000 Farelli ..... 81/3.09
6,105,468 A * 8/2000 Fohrman et al. ..... 81/3.09
7,028,359 B2 * 4/2006 Mazur ..... 7/156

* cited by examiner

*Primary Examiner*—David B Thomas
(74) *Attorney, Agent, or Firm*—Raymond M. Galasso; Galasso & Associates, LP

(57) ABSTRACT

Safety Opener is a device having a toothed opening corresponding to the ridges of a standard twist off bottle cap. To use Safety Opener, a consumer simply places a twist off bottle cap attached to a bottle underneath the toothed opening. When the bottle opener or bottle is rotated in the appropriate direction, the twist off bottle cap will loosen. It can then easily be removed by hand.

9 Claims, 1 Drawing Sheet

SAFETY OPENER

CROSS REFERENCE TO RELATED APPLICATIONS

This United States Non-Provisional patent application claims priority to U.S. Provisional Patent Application No. 60/725,102 entitled "Safety Opener" filed on Oct. 7, 2005.

FIELD OF THE DISCLOSURE

The disclosures made herein relate generally to the food and beverage industry. The invention discussed herein is in the general classification of bottle openers.

BACKGROUND

Historically, people have opened beverage bottles in a variety of ways. Often pop off caps require the use of a bottle opener to apply leverage to the cap to disengage it from its fit on the top of a bottle. A variety of bottle openers have been developed that permit a user to apply the proper force to these caps.

Twist off bottle tops permit a consumer to use his hand to maneuver the cap in a counterclockwise direction to remove it from a bottle. Unfortunately, the sharp edges and ridges on a twist off top can still cause injuries or discomfort to a user's hand. This is particularly true when a twist off top is screwed on tightly or when a user's hands are wet.

Hence, there is a need in the art for an effective and inexpensive device for unscrewing conventional twist off bottle caps.

SUMMARY OF THE DISCLOSURE

Safety Opener is a bottle opener for use with twist off bottle caps. In certain embodiments, it can also be used to open pop off bottle caps.

The principal object of this invention is to provide a device that allows a user to easily remove twist off bottle caps.

Another object of this invention is to provide a device that also allows a user to remove pop off bottle caps in the traditional manner.

Another object of this invention is to provide an affordable device for removing bottle caps.

Yet another object of this invention is to provide a device that will allow a user to safely remove bottle caps.

DETAILED DESCRIPTION OF THE DRAWINGS

The preferred embodiment of Safety Opener is comprised of an oblong frame having a circular-shaped opening on one end, a curved rectangular shaped opening on the other end, and a semicircular and toothed opening in the center.

Figure 1:
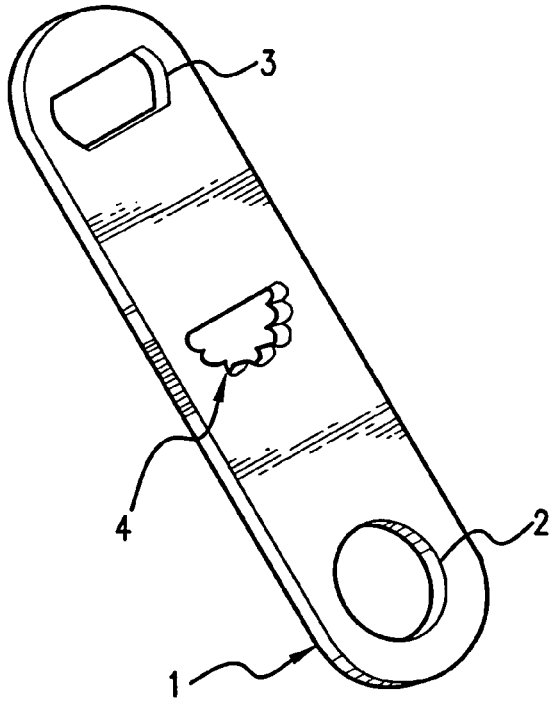
FIG. 1 depicts a perspective view of the preferred embodiment of the invention.

FIG. 1 shows a perspective view of the preferred embodiment of the invention. An oblong bottle opener frame 1 measures seven inches in length, two inches in width and one-eighth of an inch in thickness. The bottle opener frame 1 is made of heavy-gauge stainless steel in this preferred embodiment though plastic materials as well as others could be utilized. A circular shaped opening 2 is located on one end of the bottle opener frame 1. A curved rectangular shaped opening 3 is located on other end of the bottle opener frame 1. The circular shaped opening 2 and curved rectangular shaped opening 3 can be used to open pop off bottle caps in the conventional manner. A toothed semi-circular shaped opening 4 is located in the center of the bottle opener frame 1.

Figure 2:
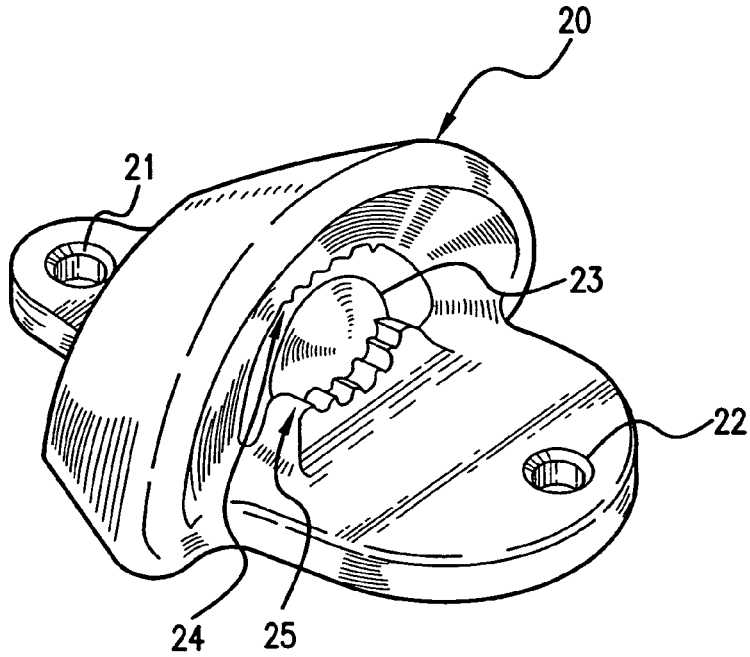
FIG. 2 depicts an alternative embodiment of the invention.

FIG. 2 shows a perspective view of an alternative embodiment of the invention. This embodiment is a wall-mounted version of the invention. A bottle opener frame 20 has a first hole 21 on the top and a second hole 22 on the bottom for easily attaching the frame 20 to a wall or door. The center of the frame 20 has a toothed socket 23 that corresponds to the shape and size of a standard bottle cap. The toothed socket 23 has a first set of teeth 24 at the top and a second set of teeth 25 at the bottom.

To use Safety Opener, a consumer simply places a twist off bottle cap attached to a bottle underneath the semi-circular, toothed opening or toothed socket in the center of the bottle opener frame. When the bottle opener or bottle is rotated in the appropriate direction, the twist off bottle cap will loosen. It can then easily be removed by hand or by using the other openings of the device. Obviously, the circular shaped opening and curved rectangular shaped opening may also be used to open pop off, rather than twist off, bottle caps.

The materials utilized for Safety Opener may vary widely but could include metal and plastic components. The metals would ideally be selected from available steel or alloys of steel and aluminum. The production process related to the use of these metals insures that the metal is non-corrosive, durable and strong. The selected metal should have high impact strength and be capable of accepting and retaining coloring materials for an extended length of time.

The plastic used in the production will ideally be selected for durability and longevity. Thermoplastics are commonly used in the manufacturing of components similar to those used in this invention. Polyethylene, polypropylene, and other similar thermoplastic materials would be among those with the necessary traits. Members of this family are recognized universally as being versatile and of high quality.

The plastic components of Safety Opener can also be formed with the use of plastic molding techniques, such as injection molding or blow molding. Injection molding requires melted plastic to be forcefully injected into relatively cool molds. As the plastic begins to harden, it takes on the shape of the mold cavity. This technique is ideal for the mass production of products. Alternatively, blow molding, a form of extrusion, could be utilized. Blow molding involves a molten tube being pushed into a mold. Compressed air then forces the molten tube against the cold walls of the mold.

It should be obvious that the components of the present invention can be of various shapes and sizes. It should also be obvious that the components of the invention can be made of different types of plastics and metals or other suitable materials and can be of any color or design. It should further be obvious that a toothed socket and toothed opening are being used synonymously herein to describe an opening of any shape that permits the ridges on a bottle cap to at least partially engage the teeth of the opening. Although this invention is primarily for use with twist off bottle caps, all of the openings could also be used to aid in opening pop off bottles as well.

It will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. A bottle opening device comprising: a frame having a toothed opening; and, a first opening and a second opening wherein said first opening is located on one end of the frame and is substantially rectangular with curved ends and wherein said second opening is located on the end opposite said first opening and said second opening is substantially circular.

2. The device of claim 1 wherein the frame is made of plastic.

3. The device of claim 1 wherein the frame is made of metal.

4. The device of claim 1 wherein the frame is made of stainless steel.

5. The device of claim 1 wherein the frame is oblong in shape.

6. The device of claim 1 wherein the frame is rectangular in shape.

7. The device of claim 1 wherein the toothed opening is semicircular.

8. The device of claim 1 wherein the toothed opening is approximately circular.

9. The device of claim 1 wherein the toothed opening is approximately centrally located on the frame.

* * * * *